US006111352A

United States Patent [19]

Hanaoka

[11] Patent Number: 6,111,352

[45] Date of Patent: Aug. 29, 2000

[54] EXPLOSION-PROOF FILM AND CATHODE-RAY TUBE

[75] Inventor: Hideaki Hanaoka, Kanagawa, Japan

[73] Assignee: Sony Corporation, Tokyo, Japan

[21] Appl. No.: 08/969,113

[22] Filed: Nov. 12, 1997

[30] Foreign Application Priority Data

Nov. 11, 1996 [JP] Japan ..... 8-298653

[51] Int. Cl.[7] ..... H01J 63/04; H01J 29/10; H01J 5/16; H01J 61/40

[52] U.S. Cl. ..... 313/479; 313/461; 313/466; 313/473; 313/477 R; 313/474; 313/478; 313/110; 313/112

[58] Field of Search ..... 313/461, 466, 313/473, 474, 477 R, 478, 479, 480, 110, 112, 113, 114

[56] References Cited

U.S. PATENT DOCUMENTS 3,708,622 1/1973 Brown, Jr. et al. .

FOREIGN PATENT DOCUMENTS 0 200 452 11/1986 European Pat. Off. .

0 527 264 2/1993 European Pat. Off. .

0 626 717 11/1994 European Pat. Off. .

950 350 2/1964 United Kingdom .

*Primary Examiner*—Nimeshkumar D. Patel

*Assistant Examiner*—Mack Haynes

*Attorney, Agent, or Firm*—Ronald P. Kananen; Rader, Fishman & Grauer

[57] ABSTRACT

An explosion-proof film being good in visibility, scratch-resistance, and workability, and a cathode-ray tube using the film. The explosion-proof film includes a transparent plastic film as a base material; and a reflection preventive film having two or more layers, which is formed on one surface of the plastic film; wherein, of the two or more layers of the reflection preventive film, at least one has a light absorption function, and at least another has a conductive function. The explosion-proof film is stuck on a surface of a panel glass constituting a display screen of a cathode-ray tube, to thereby give an explosion-proof function to the cathode-ray tube, to achieve lightweightness of the cathode-ray tub, and to obtain the optimum visual contrast. The explosion-proof film may be formed of three or more layers.

15 Claims, 5 Drawing Sheets

EXPLOSION-PROOF FILM AND CATHODE-RAY TUBE

BACKGROUND OF THE INVENTION

The present invention relates to an explosion-proof film good in visibility, scratch-resistance, and workability, which is stuck on a display screen of a cathode-ray tube.

To prevent scattering of glass due to implosion of a cathode-ray tube, there has been proposed a method of sticking an explosion-proof plastic film on a display screen of the cathode-ray tube. The sticking of such an explosion-proof film on the display screen of the cathode-ray tube is effective to reduce the thickness of a panel glass and hence to contribute to lightweightness of the cathode-ray tube, because the explosion-proof film shares a function of preventing scattering of glass which has been dependent on the panel glass or a tension band.

With respect to a transparent material through which a substance is to be viewed, when light is intensively reflected from the surface of the transparent material or when an image is clearly formed on the surface thereof, it becomes very difficult to view the substance through such a transparent material. For example, in the of spectacle lenses, a reflected image called "ghost" or "flare" formed thereon gives discomfort to eyes, and in the case of looking glass, reflected light on the glass surface obstructs clear viewing of a substance. Such a phenomenon also occurs for a panel glass of a cathode-ray tube, and to cope with such an inconvenience, various countermeasures have been proposed.

As one example of the countermeasures, there has been known a method of preventing reflection of light from the surface of a base member by coating the surface of the base member with a material having a refractive index different from that of the base member by vacuum deposition or the like. In this method, to improve the reflection preventive effect, it is important to control the thickness of the coating material. In the case where a single layer film is used as the coating material, the minimum reflectance, that is, the maximum transmittance is obtained by forming the film using a material having a refractive index lower than that of the base member and selecting an optical film thickness of the material to be equal to a quarter-wavelength of light or the quarter-wavelength multiplied by an odd number. The optical film thickness is given by a product of the refractive index of the film forming material and the thickness of the film.

As the material for forming a reflection preventive film, there is generally used a material exhibiting a low reflectance and a high transmittance of visible rays, which is represented by an inorganic oxide or an inorganic halide. Further, there are proposed several methods of forming a reflection preventive film having a plurality of layers.

In general, the transmittance of a display screen of a cathode-ray tube is adjusted by a panel glass; however, in the case of sticking an explosion-proof film on the panel glass for reducing the thickness of the panel glass and achieving lightweightness of the cathode-ray tube, the transmittance of the display screen is increased, resulting in the reduced contrast. In particular, in the case of sticking a film with a reflection preventive film made from an inorganic oxide on the panel glass, the reflection preventive film exhibits little light absorption and the degree of reflection on the surface is reduced, so that the actual transmittance is further increased, thereby further reducing the contrast.

SUMMARY OF THE INVENTION

An object of the present invention is to provide a cathode-ray tube in which an explosion-proof film is stuck on a panel glass in order to reduce the thickness of the panel glass for achieving lightweightness of the cathoderay tube, wherein visibility is enhanced by keeping at optimum values the reflectance and transmittance of light of a display portion composed of the explosion-proof film and the panel glass.

To achieve the above object, according to the present invention, there is provided an explosion-proof film including: an organic polymer film; and a reflection preventive film having two or more layers, which is formed on one surface of said organic polymer film; wherein, of said two or more layers of said reflection preventive film, at least one has a light absorption function.

The present invention also provides an explosion-proof film including: an organic polymer film; and a reflection preventive film having two or more layers, which is formed on one surface of said organic polymer film; wherein, of said two or more layers of said reflection preventive film, at least one has a light absorption function, and at least another has a conductive function.

The present invention also provides an explosion-proof film including: an organic polymer film; and a reflection preventive film having two or more layers, which is formed on one surface of said organic polymer film; wherein, of said two or more layers of said reflection preventive film, at least one has a light absorption function and a conductive function.

The present invention also provides an explosion-proof film including: an organic polymer film; and a reflection preventive film having three or more layers, which is formed on one surface of said organic polymer film; wherein, of said three or more layers of said reflection preventive film layer, at least one has a light absorption function, at least another has a conductive function, and at least the third is a dielectric layer.

The present invention also provides an explosion-proof film including: an organic polymer film; and a reflection preventive film having two or more layers, which is formed on one surface of said organic polymer film; wherein, of said two or more layers of said reflection preventive film, at least one has a light absorption function and a conductive function, and at least another is a dielectric layer.

According to the present invention, there is provided a cathode-ray tube including a panel glass on which the above explosion-proof film is stuck. In this cathode-ray tube, said panel glass may be made from a tinted material or a dark tinted material.

The explosion-proof film of the present invention makes it possible to reduce the thickness of the panel glass and hence to reduce the weight of the cathode-ray tube; to give a good reflection preventive function with a small number of layers; and to set the transmittance of light at the optimum state and hence to keep the contrast at a good state. Also, the explosion-proof film having a conductive layer exhibits an antistatic effect and an electromagnetic shielding effect. Further, since the contrast can be adjusted at the optimum value by the explosion-proof film without changing the glass material, it is possible to form various panels using only one kind of the glass material, and hence to simplify the manufacturing process and reduce the cost.

DETAILED DESCRIPTION OF THE PREFERRED EMBODIMENT

Hereinafter, embodiments of the present invention will be described in detail with reference the accompanying drawings.

The present inventor has found that the above-described problem can be effectively solved by preparing an explosion-proof film in which two or more reflection preventive films including at least one layer having a light absorption function are formed on one surface (front surface) of a transparent plastic film as a base material, and sticking the back surface of the base material on a panel glass of a cathode-ray tube.

Figure 1:
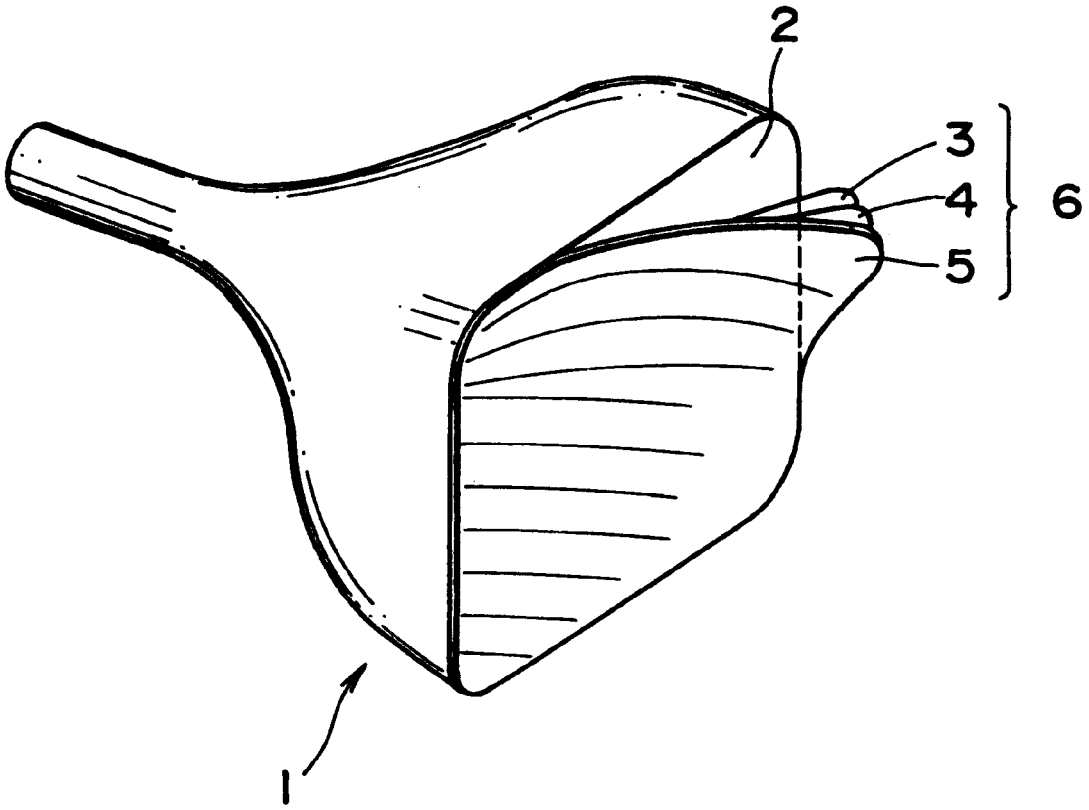
FIG. 1 is a view showing an explosion-proof film of the present invention.

Specifically, as shown in FIG. 1, an explosion-proof film 6 of the present invention is prepared by forming a first reflection preventive film 4 and a second reflection preventive film 5 in this order on a transparent plastic film 3 as a base material, and the explosion-proof film 6 thus obtained is stuck on a surface of a panel glass 2 constituting a display screen of a cathode-ray tube 1, to thereby give an explosion-proof function to the cathode-ray tube 1, to achieve light-weightness of the cathode-ray tube 1, and to obtain the optimum visual contrast. The explosion-proof film 6 may be, of course, formed of three or more layers.

First, a thin film to which the present invention pertains will be described. In some types of heat ray blocking films which are filters making use of optical thin films, a light absorption material such as Au, Pt, Pd, Ni—Cr, Al, $In_2O_3$—$SnO_2$, CuI, or CuS is contained in the film to adjusted the transmittance of light. The transmittance of visible rays of the heat ray blocking film containing the above light absorption material is generally in a range of 60% to 90%.

As the reflection preventive film, there has been used a light absorption film called "dark mirror", "selective absorption mirror" or "enhanced absorption mirror". In particular, the dark mirror is known to be usable as the reflection preventive film applied in a visible ray region. A two-layered dark mirror having a light absorption metal film in combination with a dielectric film been proposed in "Optical Thin Film User's Handbook" published by Nikkan Kougyo Sinbunsha, page 160). Such a reflection preventive film, in spite of a small number of layers, exhibits a high reflection preventive function in a wide visible ray region. On the other hand, for a reflection preventive film having only a transparent dielectric film, it needs to be of a multi-layered structure for exhibiting the same function, that is, it becomes complicated in film structure.

Next, the explosion-proof film 6 of the present invention will be described.

The plastic film as the base material of the explosion-proof film 6 can be made from any organic polymer. However, from the viewpoint of optical characteristics such as transparency, refractive index, and dispersibility, and further impact resistance, heat resistance, and durability, the plastic film is preferably made from one of the following organic polymers: polymethylmethacrylate and its copolymer; polycarbonate; diethylene glycol bisallylcarbonate (CR-39); polymer of diacrylate with bisphenol A or brominated bisphenol A, and its copolymer; polymer of dimethacrylate with bisphenol A or brominated bisphenol A, and its copolymer; polymer of urethane modified monoacrylate with bisphenol A or brominated bisphenol A, and its copolymer; polymer of urethane modified monomethacrylate with bisphenol A or brominated bisphenol A, and its copolymer; polyester, particularly, polyethyleneterephthalate, polyethylene naphthalate, or unsaturated polyester; acrylonitrilestyrene copolymer; poly (vinyl chloride); polyurethane; and epoxy resin. In addition, the plastic film can be made from an aramid based resin. The plastic film is formed by drawing the above material typically to a thickness of about 25 $\mu$m to 500 $\mu$m.

As the base material of the explosion-proof film 6, on which the reflection preventive film is to be formed, there is preferably used the above-described plastic film coated with a coating material such as a hard coat. In particular, the coating material provided under the reflection preventive film of the present invention is allowed to improve various properties such as adhesive strength, hardness, chemical resistance, durability, and dye-affinity. For example, to improve the hardness of the plastic film as the base material, the plastic film may be coated with a material known to give a high hardness to the film surface. Further, to improve the hardness, the plastic film may be coated with a coating material composed of an acrylic crosslinking material obtained by acrylic acid or methacrylic acid, pentaerythritol and the like.

As an adhesive for sticking the explosion-proof film 6 on the surface of a panel glass, there may be used one of the following adhesives: epoxy based adhesive; rubber based adhesive; acrylic based adhesive; silicone based adhesive; and the above adhesives added with a ultraviolet crosslinking agent. With respect to such an adhesive, not to degrade quality of characters and graphic patterns to be displayed on a display screen, the haze value is specified to be 20% or less, preferably, 5% or less, and the absorptance of light is specified to be 95% or less, preferably, in a range of 40% to 90%.

The reflection preventive film having a light absorption function according to the present invention can be formed by a physical film formation process such as vacuum deposition, ion plating, or sputtering; or a chemical film formation method such as spraying, dipping, CVD, or coating. Specific examples of materials suitable for CVD include, in addition to $SiO_2$, inorganic oxides such as $Al_2O_3$, $ZrO_2$, $TiO_2$, $TaHf_2$, SiO, TiO, $Ti_2O_3$, $Y_2O_3$, $YbO_3$, MgO, and $CeO_2$.

The present invention will be more clearly understood with reference to the following examples:

EXAMPLE 1

A transparent polyethyleneterephthalate (PET) film (thickness: 100 $\mu$m) was used as a base material for a reflection preventive film. One surface of the PET film was subjected to hard-coating treatment for ensuring a specific surface hardness. The hard-coating treatment is generally performed by coating the surface of a member with a raw material of an acrylic crosslinking resin and crosslinking/hardening it by ultraviolet rays or electron rays; or coating the surface of the member with a raw material of a silicone based resin, melamine based resin or epoxy based resin and thermally hardening it.

Figure 2:
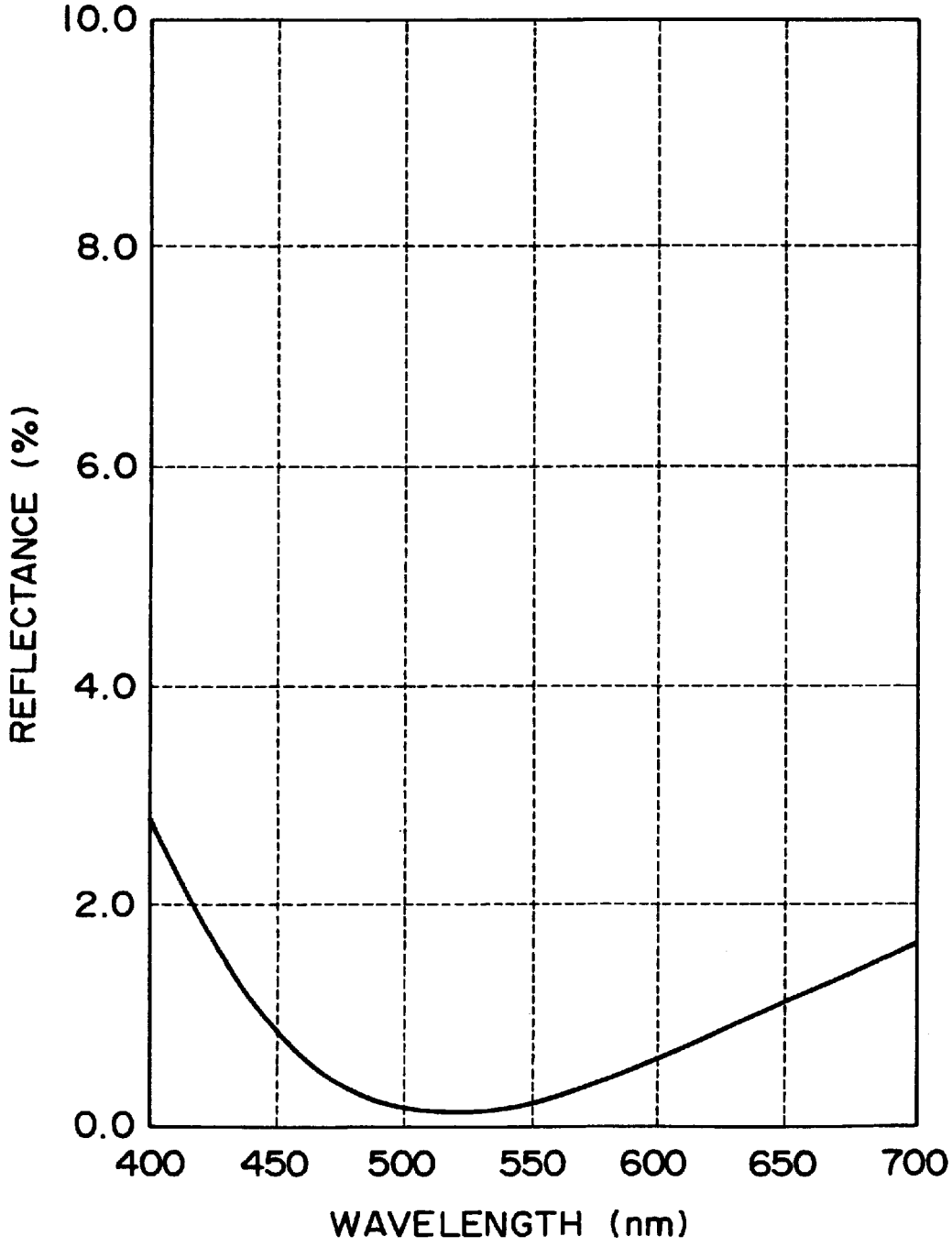
FIG. 2 is a graph showing a reflectance of light of an explosion-proof film as a first embodiment of the present invention.
Figure 3:
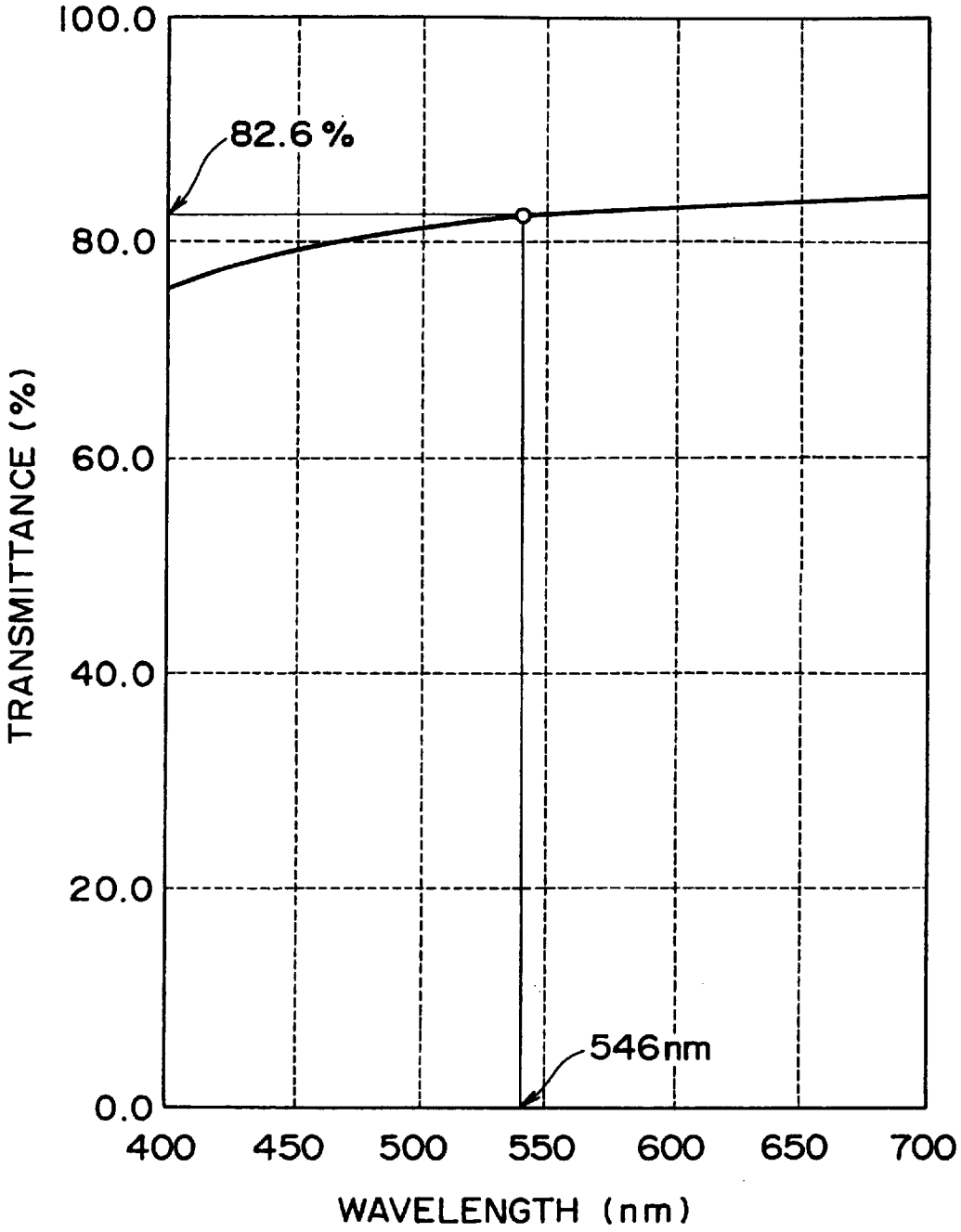
FIG. 3 is a graph showing a transmittance of light of the explosion-proof film as the first embodiment.

A light absorption layer as the reflection preventive film was formed on the resultant PET film by sputtering metal chromium to a thickness of 1 nm and then sputtering $SiO_2$ to a thickness of 80 nm. The reflectance and transmittance of the reflection preventive film thus obtained at the coat surface are shown in FIGS. 2 and 3, respectively. As will be apparent from FIG. 3, the transmittance at a wavelength of 546 nm is 82.6%.

The back surface of the PET film, opposite to the surface formed with the reflection preventive film, was uniformly coated with an acrylic adhesive to a thickness of 50 $\mu$m. The adhesive was then dried at 60° C., to form an adhesive layer having a specific adhesive strength.

The explosion-proof film thus formed was stuck on the surface of a panel glass by applying a pressure using a rubber roller. By sticking of the explosion-proof film on the panel glass, the thickness of the panel glass of a cathode-ray tube having a size of 32 inch (aspect ratio: 16:9) was able to be 3 mm reduced from a usual value, 16 mm to 13 mm with the same strength being kept. In addition, there was used the glass panel made from a glass material specified in H-4601 of the Standard EIAJ. For the panel glass having a thickness of 16 mm, the transmittance of light at the wavelength of 546 nm was 31.5%, while for the panel glass having a thickness of 13 mm, it was 38%.

Accordingly, the transmittance of light (wavelength: 546 nm) of the panel glass stuck with the explosion-proof film was calculated from the following equation:

transmittance of panel glass (38%)×transmittance of explosion-proof film (82.6%)=31.3%

In addition, reflection at the boundary between the PET film and the adhesive and reflection at the boundary between the adhesive and the panel glass are very small in difference in refractive index, and therefore, is omitted.

As described above, with respect to the panel glass stuck with the explosion-proof film having the specific reflectance and transmittance, the contrast was similar to that of the related art one and the glass thickness was reduced from 16 mm to 13 mm. In other words, the panel glass in this embodiment was reduced in weight with the contrast being kept at a value comparable to the related art one.

While the example in which the explosion-proof film of the present invention was used for the cathode-ray tube of the size of 32 inch (aspect ratio: 16:9), the same effect can be of course obtained by applying the explosion-proof film to cathode-ray tubes having other sizes.

EXAMPLE 1

A transparent polyethyleneterephthalate (PET) film (thickness: 100 $\mu$m) was used as a base material for a reflection preventive film. One surface of the PET film was subjected to hard-coating treatment in the same manner as described in Example 1 for ensuring a specific surface hardness.

Figure 4:
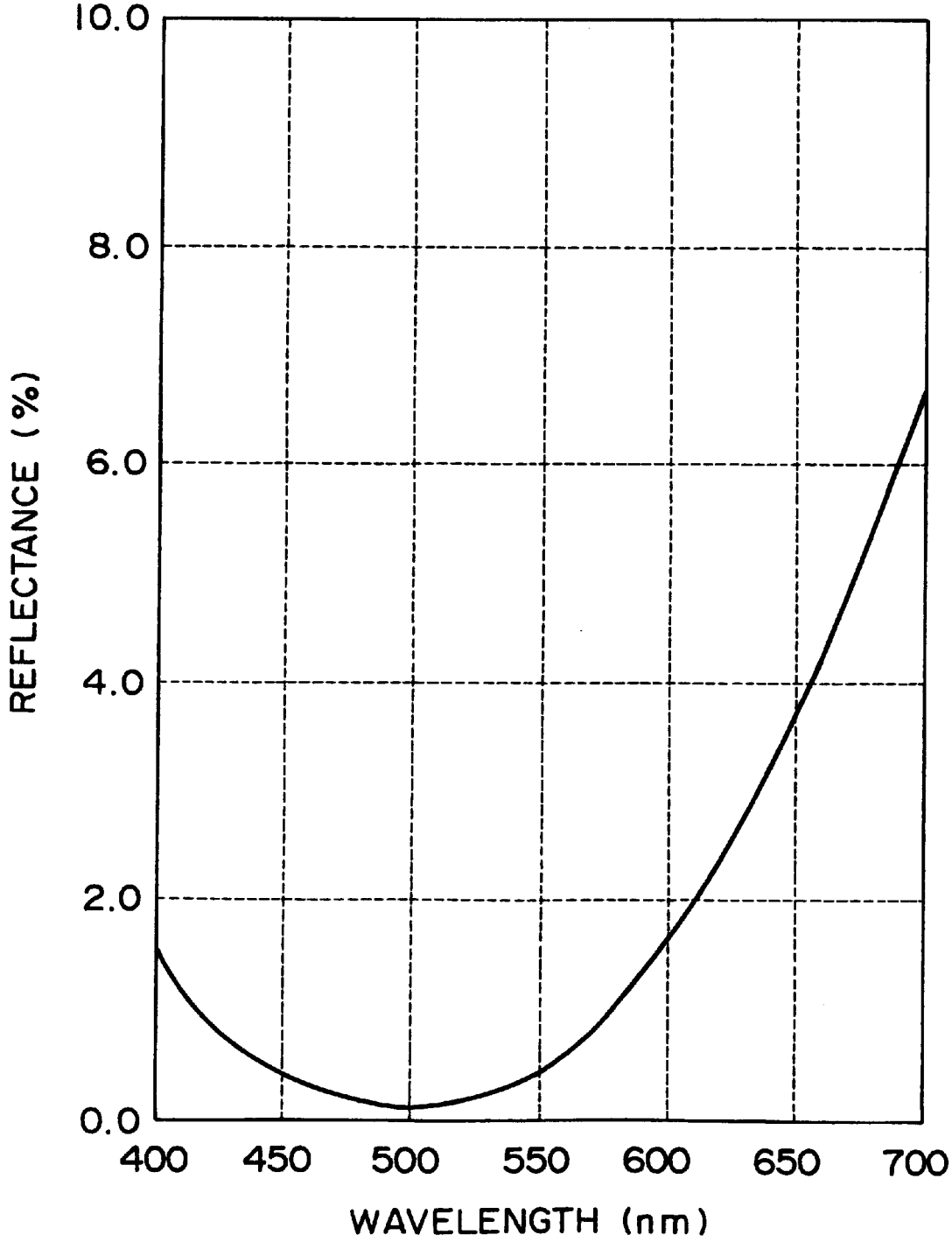
FIG. 4 is a graph showing a reflectance of light of an explosion-proof film as a second embodiment of the present invention.
Figure 5:
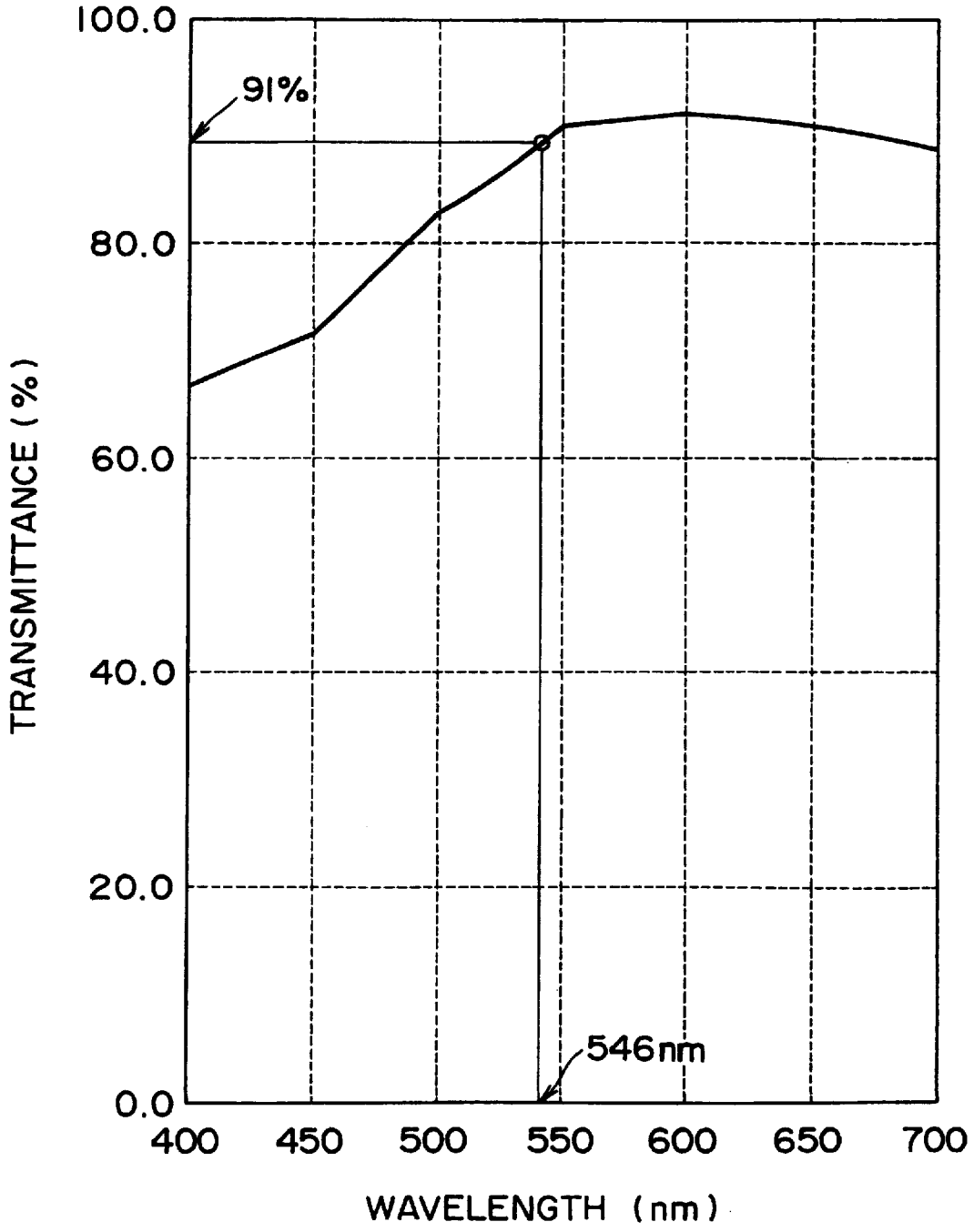
FIG. 5 is a graph showing a transmittance of light of the explosion-proof film as the second embodiment.

A light absorption layer as the reflection preventive film was formed on the resultant PET film by sputtering metal gold to a thickness of 8.5 nm and then pre-sputtering $SiO_2$ to a thickness of 63 nm. The reflectance and transmittance of the reflection preventive film thus obtained at the coat surface are shown in FIGS. 4 and 5, respectively. As will be apparent from FIG. 5, the transmittance at a wavelength of 546 nm is 91%.

The back surface of the PET film, opposite to the surface formed with the reflection preventive film, was uniformly coated with an acrylic adhesive to a thickness of 50±2 $\mu$m. The adhesive was then dried at 60° C., to form an adhesive layer having a specific adhesive strength.

The explosion-proof film thus formed was stuck on the surface of a panel glass by applying a pressure using a rubber roller. By sticking of the explosion-proof film on the panel glass, the thickness of the panel glass of a cathode-ray tube having a size of 28 inch (aspect ratio: 16:9) was able to be 2 mm reduced from a usual value, 14.5 mm to 12.5 mm with the same strength being kept. In addition, there was used the glass panel made from a glass material specified in H-5702 of the Standard EIAJ. For the panel glass having a thickness of 14.5 mm, the transmittance of light at the wavelength of 546 nm was 46%, while for the panel glass having a thickness of 12.5 mm, it was 50.5%.

Accordingly, the transmittance of light (wavelength: 546 nm) of the panel glass stuck with the explosion-proof film was calculated from the following equation:

transmittance of panel glass (50.5%)×transmittance of explosion-proof film (91%)=46%

In addition, reflection at the boundary between the PET film and the adhesive and reflection at the boundary between the adhesive and the panel glass are very small in difference in refractive index, and therefore, is omitted.

As described above, with respect to the panel glass stuck with the explosion-proof film having the specific reflectance and transmittance, the contrast was similar to that of the related art one and the glass thickness was reduced from 14.5 mm to 12.5 mm. In other words, the panel glass in this embodiment was reduced in weight with the contrast being kept at a value comparable to the related art one.

While the example in which the explosion-proof film of the present invention was used for the cathode-ray tube of the size of 28 inch (aspect ratio: 16:9), the same effect can be of course obtained by applying the explosion-proof film to cathode-ray tubes having other sizes.

While the preferred embodiments of the present invention have been described using specific terms, such description is for illustrative purposes only, and it is to be understood that changes and variations may be made without departing from the spirit or scope of the following claims.

What is claimed is:

1. A cathode-ray tube having an explosion-proof film, comprising:

a panel glass;

an organic polymer film, having a front surface and a back surface, wherein the entire back surface is adhered to said panel glass; and a reflection preventive film having two or more layers, which is formed on said front surface of said organic polymer film;

wherein, at least one of said two or more layers of said reflection preventive film has a light absorption function.

2. cathode-ray tube having an explosion-proof film according to claim 1, wherein at least another of said two or more layers of said reflection preventive film has a conductive function.

3. A cathode-ray tube having an explosion-proof film according to claim 1, wherein, of said two or more layers of said reflection preventive film, said at least one layer that has a light absorption function also has a conductive function.

4. A cathode-ray tube having an explosion-proof film according to claim 1, wherein, of said two or more layers of said reflection preventive film, said at least one layer that has a light absorption function also has a conductive function, and at least another second layer is a dielectric layer.

5. A cathode-ray tube having an explosion proof film according to claim 1, wherein said panel glass is made from a tinted material.

6. A cathode-ray tube having an explosion proof film according to claim 1, wherein said panel glass is made from a material tinted in a dark color.

7. A cathode-ray tube having an explosion proof film according to claim 1, wherein said organic polymer film is coated with a coating material composed of an acrylic crosslinking material.

8. A cathode-ray tube having an explosion proof film according to claim 1, wherein said back surface of said organic film is stuck directly on said panel glass using an adhesive having a haze value no greater than 20%, and no greater than 95% light absorptance.

9. A cathode-ray tube having an explosion proof film according to claim 8, wherein said adhesive has a haze value of 5%, and between about 40% and about 90% light absorptance.

10. A cathode-ray tube having an explosion-proof film, comprising:

a panel glass;

an organic polymer film, having a back surface stuck directly on said panel glass, and a front surface; and a reflection preventive film having three or more layers, which is formed on said front surface of said organic polymer film;

wherein, of said three or more layers of said reflection preventive film layer, at least one has a light absorption function, at least another has a conductive function, and at least the third is a dielectric layer.

11. A cathode-ray tube having an explosion proof film according to claim 10, wherein said panel glass is made from a tinted material.

12. A cathode-ray tube having an explosion proof film according to claim 10, wherein said panel glass is made from a material tinted in a dark color.

13. A cathode-ray tube having an explosion proof film according to claim 10, wherein said organic polymer film is coated with a coating material composed of an acrylic crosslinking material.

14. A cathode-ray tube having an explosion proof film according to claim 10, wherein said back surface of said organic film is uniformly adhered to said panel glass using an adhesive having a haze value no greater than 20%, and no greater than 95% light absorptance.

15. A cathode-ray tube having an explosion proof film according to claim 14, wherein said adhesive has a haze value of 5%, and between about 40% and about 90% light absorptance.

* * * * *